US009205492B2

(12) United States Patent
Berglund

(10) Patent No.: US 9,205,492 B2
(45) Date of Patent: Dec. 8, 2015

(54) METHOD FOR MANUFACTURING A POWDER BASED ARTICLE

(75) Inventor: Thomas Berglund, Falun (SE)

(73) Assignee: Sandvik Intellectual Property AB, Sandviken (SE)

( * ) Notice: Subject to any disclaimer, the term of this patent is extended or adjusted under 35 U.S.C. 154(b) by 1083 days.

(21) Appl. No.: 13/262,421

(22) PCT Filed: Mar. 31, 2010

(86) PCT No.: PCT/SE2010/050361

§ 371 (c)(1),
(2), (4) Date: Jan. 5, 2012

(87) PCT Pub. No.: WO2010/114474

PCT Pub. Date: Oct. 7, 2010

(65) Prior Publication Data

US 2012/0135166 A1 May 31, 2012

(30) Foreign Application Priority Data

Apr. 2, 2009 (EP) ..... 09157166

(51) Int. Cl.
*B22F 7/06* (2006.01)
*B22F 5/10* (2006.01)

(52) U.S. Cl.
CPC ... *B22F 7/06* (2013.01); *B22F 5/10* (2013.01); *B22F 5/106* (2013.01); *B22F 2998/10* (2013.01); *Y10T 428/13* (2015.01)

(58) Field of Classification Search
USPC ..... 419/5, 6, 7, 8, 37
See application file for complete search history.

(56) References Cited

U.S. PATENT DOCUMENTS 3,940,268 A * 2/1976 Catlin ..... 419/8
4,063,939 A * 12/1977 Weaver et al. ..... 419/5

(Continued)

FOREIGN PATENT DOCUMENTS

DE 33 10 038 9/1984
EP 0 543 353 11/1992

(Continued)

OTHER PUBLICATIONS

Notification of the First Office Action (and English translation) for Chinese Patent Application No. 201080016177.0, dated Apr. 1, 2013.

(Continued)

*Primary Examiner* — George Wyszomierski
*Assistant Examiner* — Ngoclan T Mai
(74) *Attorney, Agent, or Firm* — Morgan, Lewis & Bockius LLP

(57) ABSTRACT

A method for manufacturing a powder based article comprising one portion of a first material and at least one portion of a second material comprising the steps of:

arranging at least a first body comprising a powder of the second material and a gasifiable material in a selected portion or selected portions in a capsule defining the shape of the article, wherein the powder of the second material is held by the gasifiable material;

filling the capsule with a powder of the first material;

removing the gasifiable material;

sealing the capsule;

heating the capsule under increased pressure to a temperature at which the powders of the first and second materials densifies to a compact article.

22 Claims, 7 Drawing Sheets

(56) References Cited

U.S. PATENT DOCUMENTS

| | | | | |
|---|---|---|---|---|
| 4,492,737 | A * | 1/1985 | Conolly | 428/552 |
| 5,445,787 | A * | 8/1995 | Friedman et al. | 419/38 |
| 5,792,403 | A | 8/1998 | Massa et al. | |
| 6,042,780 | A * | 3/2000 | Huang | 419/36 |
| 2008/0199343 | A1 * | 8/2008 | Rust et al. | 419/6 |

FOREIGN PATENT DOCUMENTS

| | | |
|---|---|---|
| GB | 2 304 619 | 3/1997 |
| JP | 61-266106 | 11/1986 |
| JP | 62-243701 | 10/1987 |
| JP | 63-026301 | 2/1988 |
| JP | 63-033504 | 2/1988 |
| JP | 3-125076 | 5/1991 |
| JP | 07-041802 | 2/1995 |
| JP | 08-225802 | 9/1996 |
| JP | 10-298609 | 11/1998 |
| JP | 11-128638 | 5/1999 |
| JP | 2004-149826 | 5/2004 |

OTHER PUBLICATIONS

Notification of the Second Office Action (with English translation) for Chinese Patent Application No. 201080016177.0, dated Nov. 8, 2013.

Office Action (with English translation) for Japanese Patent Application No. 2012-503373, dated Dec. 16, 2014.

JPO: First Office Action (Notice of Reasons for Rejection) for Japanese Patent Application No. 2012-503373—Issued on Feb. 4, 2014—Including English Translation.

International Search Report for PCT/SE2010/050361.

Office Action (with English translation) for Japanese Patent Application No. 2012-503373, dated Aug. 25, 2015.

* cited by examiner

METHOD FOR MANUFACTURING A POWDER BASED ARTICLE

RELATED APPLICATIONS

The present application is a U.S. National Phase Application of International Application No. PCT/SE2010/050361 (filed 31 Mar. 2010) which claims priority to European Application No. 09157166.1 (filed 2 Apr. 2009).

TECHNICAL FIELD

The present invention relates to a method for manufacturing a powder based article. In particular the present invention relates to the field of hot isostatic pressing manufacturing, HIP.

BACKGROUND ART

Hot isostatic pressing of metallic or ceramic powders, so called HIP or HIPPING is a commonly used manufacturing process for various articles. In the HIP manufacturing process a capsule which defines the shape of the article is filled with a metal or ceramic powder of desired composition. The capsule is evacuated, sealed and thereafter subjected to increased temperature and pressure whereby the powder is densified into a compact body.

Powder based articles may in certain applications be subjected to conditions that varies along the article. Alternatively, may the design and geometry of the article be such that different parts or portions are more exposed to the surrounding environment than others. For example, the load or the pressure may be larger on one portion of the article than on another portion of the article. The wear, for example abrasive wear, that an article is subjected to, may also be larger on one portion than on another portion of the article. Due to increased wear, for example, on certain portions of the article, the article may wear out or break earlier than expected from the overall wear. The non-limiting terms "varying physical influence" and "increased physical influence" are used hereinafter to include all types of effects from the surrounding environment on the article, and that the effect may be more pronounced on one portion of the article than another, respectively.

Attempts have been made to reinforce powder based articles by increasing the dimensions of the article in the portions where it is subjected to increased physical load. However, due to dimension requirements this is not always possible.

Other attempts to reinforce powder based articles include flame coating as described in EP 0543353 A1 and JP 3125076 A1. However, these methods have had limited success. The microstructure of the article degrades due to the heat from the coating process. It has further proven difficult to reach certain portions of the articles with the flame coating tools. The thickness of the applied layer, as well as the choice of materials that can be used, is also limited in the known methods.

SUMMARY OF THE INVENTION

Thus, it is an object of the present invention to provide an improved method for manufacturing a powder based article which has reinforced portions.

This object is achieved by the method for manufacturing a powder based article comprising one portion of a first material and at least one portion of a second material comprising the steps of:

arranging at least a first body comprising a powder of the second material and a gasifiable material in a selected portion or selected portions in a capsule defining the shape of the article, wherein the powder of the second material is held by the gasifiable material;

filling the capsule with a powder of the first material;

removing the gasifiable material;

sealing the capsule;

heating the capsule under increased pressure to a temperature at which the powders of the first and second materials densifies to a compact article.

Since the powder of the second material is held by the gasifiable material it may easily be arranged at any position in the capsule. By "held" is meant that the gasifiable material holds the powder material together in a body of such strength that the body can be handled without breaking. The second material may therefore be integrated into the article during manufacturing of the same. When the gasifiable material has been removed from the capsule, the powder of the second material is held together and retained in the desired position by the surrounding powder of the first material and, if present the, walls of the capsule.

The above process allows for fast Near Net Shape or Net Shape manufacturing of an article which comprises portions with different materials. Portions of the article which are subjected to increased physical influence may thereby be reinforced. A further advantage is that the second material can be applied at positions which previously not have been possible to access and therefore also not been possible to reinforce. Since the second material is integrated in the body of the article, a wide variety of materials having different properties can be applied without interfering with the form and shape of the article. By the integration of a coherent body of a powder of the second material in the main body of the article before densifying of the article a very high adhesion between the second body and the main body of the article is achieved. The above process allows for the manufacturing of a reinforced powder based article which has excellent mechanical properties since the material of the article is of high purity with a fine microstructure.

The body may be arranged at the inner surface of a wall of the capsule so that the body is partially enclosed in powder material. Thereby is achieved an effective method for manufacturing an article which has a surface which is resistant against physical influence such as abrasion or corrosion.

Alternatively, the body may be arranged at a distance from the inner surface of a wall of the capsule so that the body is enclosed in powder material. Thereby is achieved an effective method for manufacturing an article which is reinforced against physical influence, such as heavy loads or impacts.

Preferably, the capsule forms a hollow cylinder wherein the body is arranged in contact with the mantle surface of an inner wall of the cylinder, partially enclosing the mantle surface.

Preferably, the capsule forms a hollow cylinder with a curved section wherein the body is arranged in contact with the mantle surface of an inner wall of the cylinder, partially enclosing the mantle surface.

Preferably, the body is arranged in a curved section of the capsule.

According to one alternative, the body comprises one or more shells of gasifiable polymer material, wherein the shell or shells are filled or pre-filled with a powder of at least the second material. Such shells are easy to manufacture at low cost and is further easy to handle and position or attach in the capsule.

According to one alternative, the body comprises one or more shells of polymer material and a powder of at least the first material and/or at least the second material; wherein the shell or shells are filled or pre-filled with at least the powder of the second material. The shell integrates well with the surrounding first material whereby strong adherence between the first and second materials is achieved after removal of the polymer and densifying.

The use of a shell comprising polymer material and a powder of the first and the second material minimizes the amount of polymer material that should be gasified in a subsequent process step.

According to one alternative, the capsule is partially filled with a powder of the first material, wherein the shell is arranged in the capsule, wherein the shell subsequently is filled with at least a powder of the second material, where after the capsule is completely filled with the powder of the first material. By executing the filling steps in this sequence, the shell is supported by the powder of the first material in the capsule. The shell is thereby secured during filling. A further advantage is that the shell may be positioned at any position in the capsule without the use of fastening means.

According to one alternative, the body comprises one or more solid bodies of a gasifiable polymer material and a powder of the second material. The solid body may be prefabricated in large numbers and provides the advantage of a fast production of the article since no filling of the body is necessary. A further advantage is that bodies of very complicated geometries may readily be manufactured and integrated into the article. The solid body further integrates well with the surrounding material.

Preferably is the amount of polymer powder in the mixture that makes up the body adjusted such that the volume of the polymer powder is essentially equal to the volume of the voids between the particles of the powders of the first or second materials. The polymer material is then only present in the voids between the powder material and distortion due to volume changes when the polymer material is removed by gasification is thereby minimized The prefabricated solid body may comprise layers or portions of different powder materials. Thereby is achieved an effective method of producing an article into which different types of reinforcements are integrated. For example, one portion of the prefabricated body may comprise protection against diffusion of alloy elements and another portion of the body may provide abrasion resistance.

Several bodies may be arranged in the capsule. Thereby is achieved an effective method for producing an article which is reinforced in different portions.

The bodies may comprise different powder materials such that one portion of the article may be reinforced against one type of physical influence, for example abrasion and another portion of the article may be reinforced against a different type physical influence, for example corrosion.

The bodies may be arranged adjacent each other such that a gradient is formed.

The first material may preferably be any among Ni-alloys, Co-alloys, tool steels, carbon steels, Hadfield-type steels, stainless steels such as martensitic stainless steels, chromium steels, austenitic stainless steels, duplex stainless steels or mixtures thereof.

The second, third or further materials may preferably be any among Ni-alloys, Co-alloys, tool steels, carbon steels, Hadfield type steels, stainless steels such as martensitic stainless steels, chromium steels, austenitic stainless steels, duplex stainless steels or mixtures of the aforementioned materials or ceramics such as TiN, TiC, WC, $TiB_2$, metal matrix composites or mixtures thereof. These types of materials provide good reinforcement against abrasion, shocks, corrosion, etc.

The gasifiable material may be a thermal gasifiable polymer material, such as polypropylene or polyethylene wherein step of removing the polymer material from the capsule comprises the sub-steps of:

applying vacuum in the capsule;

heating the capsule to a temperature at which the polymer material is gasified;

The aforementioned polymer materials are easy to shape and evaporate when heated without essentially leaving residues in the capsule.

Alternatively, the gasifiable material may be a chemically gasifiable polymer material, such as polyoxymethylene, POM wherein the step of removing the polymer material from the capsule comprises the sub steps of:

applying vacuum in the capsule;

injecting in the capsule a gas which chemically reacts with the polymer such that the polymer material is gasified;

The aforementioned polymer materials are easy to shape and can easily be removed by gasification due to chemical reaction with the gas without essentially leaving residues in the capsule.

The method may preferably be used to manufacture an article, such as a pump housing, a pipe, a pipe bend, an impeller, a manifold or a centrifugal separator which comprises one portion of a first material and at least one portion of a second material.

DETAILED DESCRIPTION OF EMBODIMENTS

Figure 1:
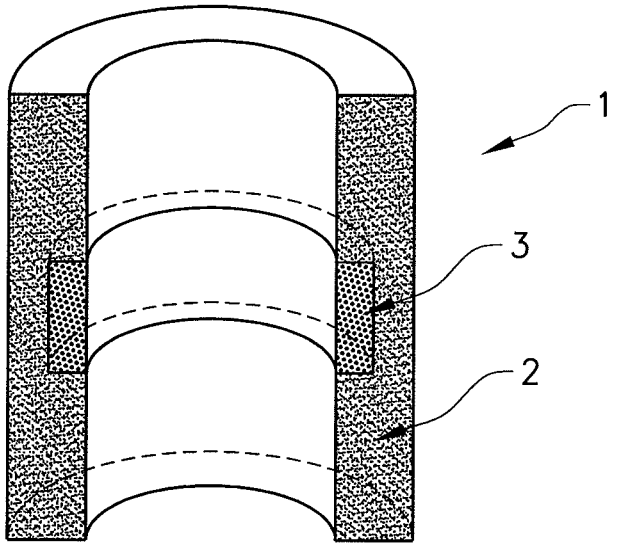
FIG. 1 illustrates a cross-section of a powder based article comprising a first portion of a first material and a second portion of a second material.

Definition of terms which are used in the following:

By "first material" is intended the material of a first portion of the manufactured article. The first portion is normally the main body of the article. The first material could be any type of metal or metal alloy that may be densified into a solid compact article having the necessary structural strength for its field of application. For example, Ni-alloys, Co-alloys, tool steels, carbon steels, Hadfield-type steels, stainless steels such as martensitic stainless steels, chromium steels, austenitic stainless steels, duplex stainless steels or mixtures of the aforementioned materials.

By "second material" is intended the material of a second portion of the article, thus a portion different from the first portion. The second material could be any type of metal, metal alloy or ceramic or metal-ceramic composite that may be densified into a solid compact article having the necessary structural strength and reinforcing properties for its field of application. For example, Ni-alloys, Co-alloys, tool steels, carbon steels, Hadfield-type steels, stainless steels such as martensitic stainless steels, chromium steels, austenitic stainless steels, duplex stainless steels, or ceramics such as TiN, TiC, WC, $TiB_2$, metal matrix composites or mixtures of the aforementioned materials. The second material may also be a mixture of the first material and the aforementioned materials.

By "third material" or "further material" is intended the material of a third portion or further portions of the article. The third material etc may be any type of the materials listed above or mixtures thereof.

Typically, the materials of the first, second and third etc portions are of different chemical composition. However, the materials of the different portions could also be of the same chemical composition but having different microstructures, for example include different phases or varying grain size.

In the inventive method for manufacturing the article the "first material", "second material", "third material" etc described above are provided as powder materials of a particle size of 1-500 μm. By "powder of the first material" is intended the powder material that is provided for the first region of the article. By "powder of the second material" or "powder of the third material" etc. is intended the powder materials that are provided for the second, third and further regions of the article.

The material of a portion in the finished article, is normally of the same chemical composition or microstructure, e.g. phase, grain size, etc as the powder material that has been provided for the portion.

However, the material of a portion in the finished article may also differ from the powder material that has been provided for the portion, e.g. be of different chemical composition or microstructure. The differences are caused by the influence of process parameters on the materials during the manufacturing process, For example, diffusion of elements may occur due to the increased temperature and pressure during the manufacturing process.

FIG. 1 describes schematically a cross-section of a powder based article 1 which is produced by the method according to the invention. The article shown in FIG. 1 is a pipe of the type which may be used in off-shore oil drilling applications. However, the article could be any type of article, for example, a pump housing, a piston, a pipe, a pipe bend, an impeller, a manifold or a centrifugal separator. As can be seen from FIG. 1 the main body 2 of the pipe is made of a first material, for example a stainless steel. The pipe further comprises a portion 3, which extends three-dimensionally at the inner surface of the pipe 1. The portion 3 comprises a second material, which is resistant to corrosion and/or erosion, for example a Ni-alloy or a Metal Matrix Composite. The pipe is thereby reinforced in a position where the pipe is subjected to wear. The portion 3 may also be located at any other position on the main body 2 of the article 1, for example incorporated in the main body 2 of the article or located at the outer surface of the article or at the ends of the article. Any material may be used in the main body 2 and in the portion 3 as long as the materials could be densified into a solid compact article having the necessary structural strength for its field of application.

Figure 2A:
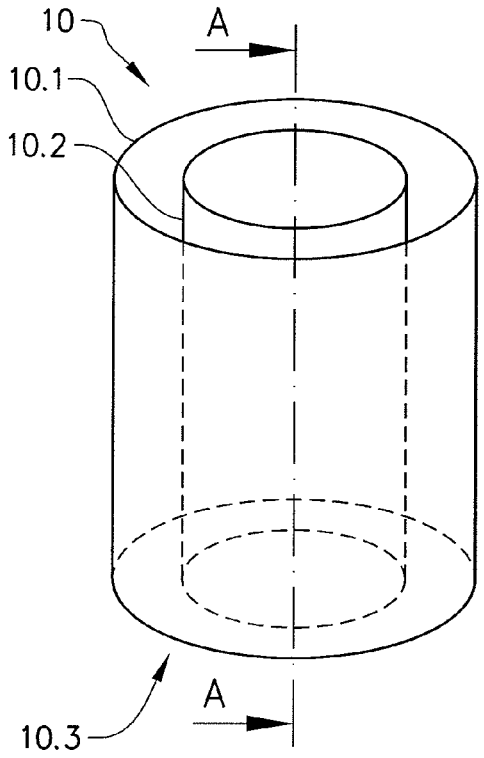
FIG. 2*a*-2*c* illustrates capsules that used in the method for forming a powder based article.
Figure 2B:
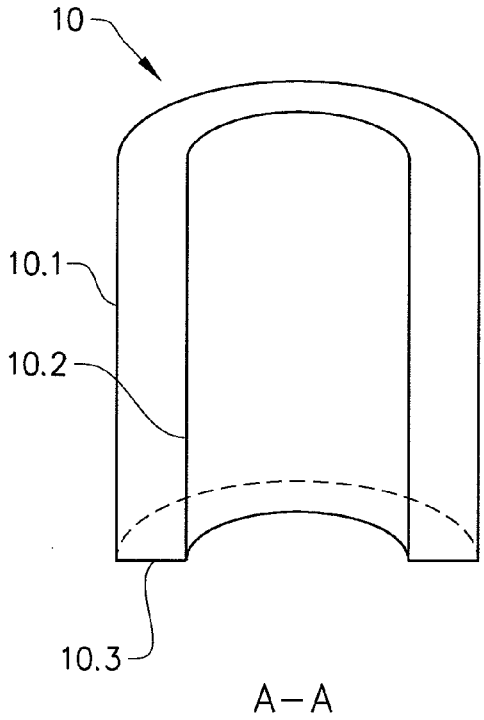

FIG. 2*a* illustrates an example of a capsule 10 that is used in the inventive method for manufacturing a powder based article. The capsule 10 defines the form of the article and may be of any configuration depending on form of the article that is manufactured. FIG. 2*b* illustrates a cross-section of the capsule 10 along the line A-A. The capsule 10 comprises an outer wall 10.1 and an inner wall 10.2 which are arranged concentrically such that a space is formed between the outer and the inner walls. At the bottom of the capsule 10 the space is closed by a bottom wall 10.3. The outer and inner walls 10.1 and 10.2 may for example be manufactured by welding together metal sheets, such as sheets of mild steel. The bottom wall 10.3 may also be a sheet of metal which is welded to the edges of the inner and outer walls 10.1, 10.2.

According to one alternative, the outer wall 10.1 and the inner wall 10.2 may be cylindrical i.e. tube shaped. The capsule thereby defines the shape of a hollow cylinder, i.e. a pipe.

Figure 2C:
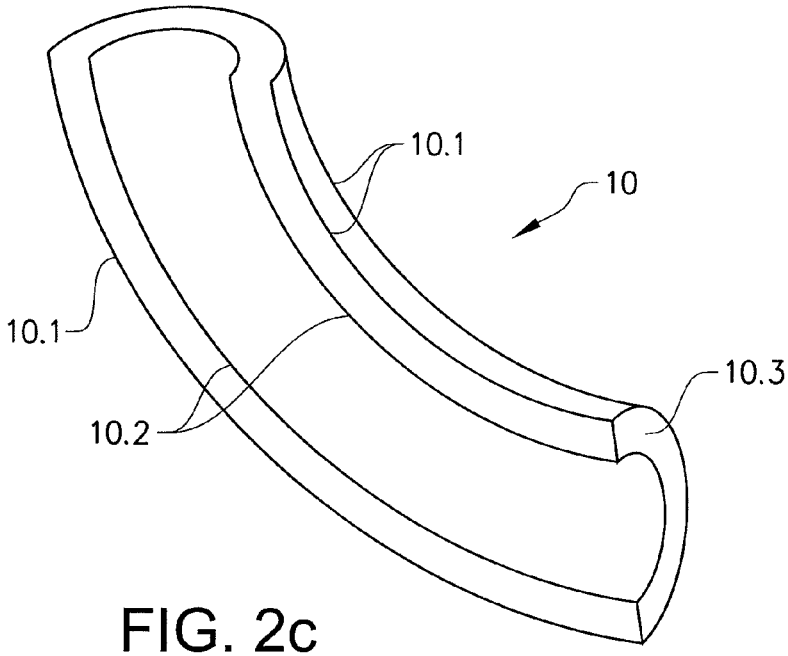

According to a second alternative, see FIG. 2*c*, the outer wall 10.1 and the inner wall 10.2 may be cylindrical and including a curved section. The capsule thereby defines the shape of a hollow cylinder with a curved section, i.e. a pipe bend.

Figure 3:
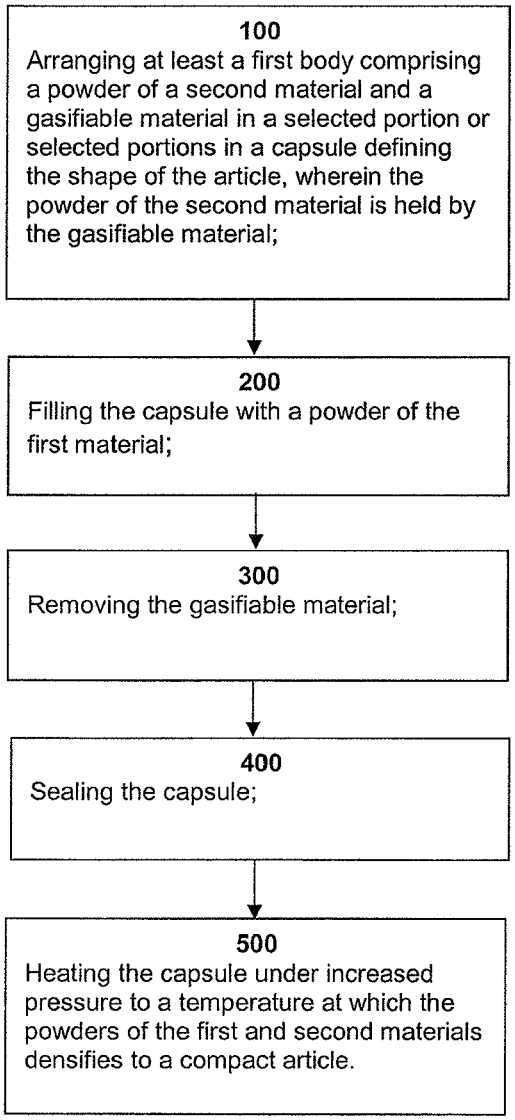
FIG. 3 is a flowchart showing the steps of the inventive method for forming a powder based article.

Following are described the steps of the inventive method for manufacturing a powder based article 1 comprising one portion 2 of a first material and a portion 3 of a second material. The steps of the method can be followed in the flowchart of FIG. 3.

In a first step 100, at least one body 11 that comprises a powder of the second material and a gasifiable material is arranged in a capsule that defines the shape of the article. The powder of the second material is held by the gasifiable material. Thereby, the body 11 can be handled without breaking.

Figure 4A:
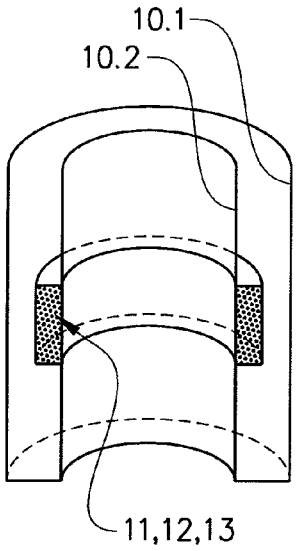
FIG. 4*a*-4*e* illustrates steps of embodiments of the inventive method for forming a powder based article.

The body 11 may have any configuration suitable for the portion of the article that shall be reinforced and may be arranged at any suitable position in the capsule 10. FIG. 4*a* illustrates a body 11 that has the configuration of a ring segment. The body may also be ring-shaped, rectangular, disc-shaped or curved. The body 11 is arranged in the space between the outer and inner walls 10.1, 10.2 of the capsule 10. The body 11 may be attached to the inner surface of the inner or outer wall 10.2, 10.2 by gluing, welding, riveting, screwing or press fitting, for example. The body may also be arranged at a distance from the walls. Several bodies may be arranged in the capsule.

According to a first alternative, the gasifiable material of the body is a polymer material of a type which evaporates without essentially leaving residues when it is heated above a certain temperature. For example polypropylene or polyethylene, which both completely evaporate at the temperatures of 450° C.-500° C.

According to a second alternative, the gasifiable material of the body is a polymer material of a type which is gasified when it reacts chemically with a gas. For example polyoxymethylene, POM, that is gasified by reaction with $HNO_3$ gas.

Figure 4B:
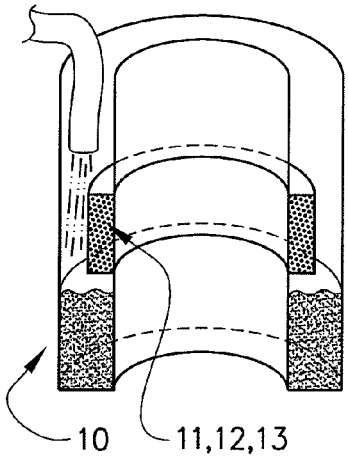
Figure 4C:
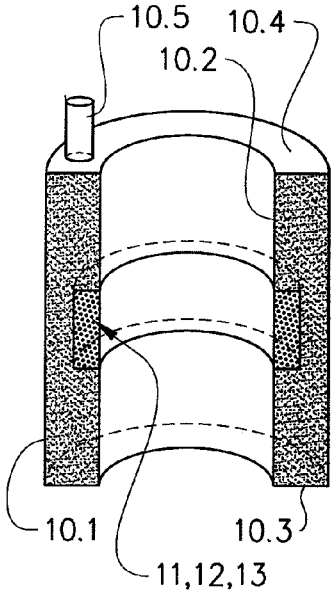

In a second step 200, the capsule 10 is filled with a powder of the first material. FIG. 4*b* illustrates the filling of the capsule 10. After filling, the capsule 10 may be covered by a top wall 10.4 which comprises an opening 10.5, see FIG. 4*c*. An evacuation pipe may be attached to opening 10.5.

According to an alternative, the second step 200 may be partially performed before the first step 100. So that, the capsule first is partially filled, thereafter is the body arranged in the capsule and then is the capsule completely filled. The body 11 may thereby be supported on the powder material in the capsule.

In a third step 300, the gasifiable material is removed from the filled capsule 10.

As described, the gasifiable material may be a thermal gasifiable polymer. In this case the step 300 of removing the gasifiable material comprises the sub-step of applying a vacuum in the capsule and the sub-step of heating the capsule to a temperature at which the polymer material is gasified.

Figure 4D:
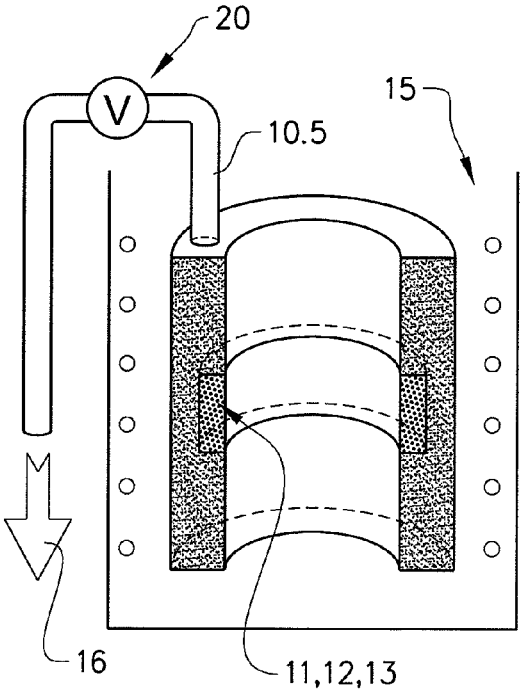

First, see FIG. 4*d*, the capsule 10 is placed in an oven, alternatively may heating elements 15 be arranged around the capsule. A vacuum is applied in the capsule by a vacuum pump 20 which is attached to the opening 10.5 in the capsule 10. The capsule 10 is then heated to a temperature at which the polymer material in the body 11 is gasified. To achieve a complete gasification of the polymer material, the capsule may be heated to approximately 550° C. and held at this temperature for a predetermined time period, for example 60 min, depending on capsule size, geometry and number of evacuating pipes. The gasified polymer material is drawn from the capsule 10 as a gas 16 by the vacuum pump 20.

As also described, the gasifiable material may be a polymer material which is gasified by chemical reaction with a gas. In this case the step of removing the gasifiable material comprises the sub-step of applying a vacuum in the capsule and the sub-step of injecting in the capsule a gas which chemically reacts with the polymer such that the polymer is gasified.

First, a vacuum is first drawn in the capsule by a vacuum pump 20 which is attached to an evacuation pipe in the opening 10.5 in the capsule. The vacuum pump 20 is thereafter stopped and a gas, for example $HNO_3$-gas is injected into the capsule. The gas reacts chemically with the polymer material which gasifies. The vacuum pump 20 is then started again to evacuate the gasified polymer material from the capsule, whereupon a vacuum again is applied in the capsule. The pump is thereafter stopped and the $HNO_3$-gas is injected again. The process is repeated until the polymer material is completely gasified.

In a fourth step 400, the capsule is sealed such that the vacuum that is drawn in the capsule during removal of the polymer material is maintained. Before sealing of the capsule a gas, e.g. $N_2$ may be injected into the capsule. The $N_2$ gas ensures that no argon, oxygen or gasified carbon is present in the capsule. The sealing of the capsule is achieved by clamping of the evacuating pipe in opening 10.5 using a suitable tool and welding the opening shut.

In a fifth step 500, the capsule 10 heated under increased pressure to a temperature at which the powders of the first and second materials densifies to a compact article.

Figure 4E:
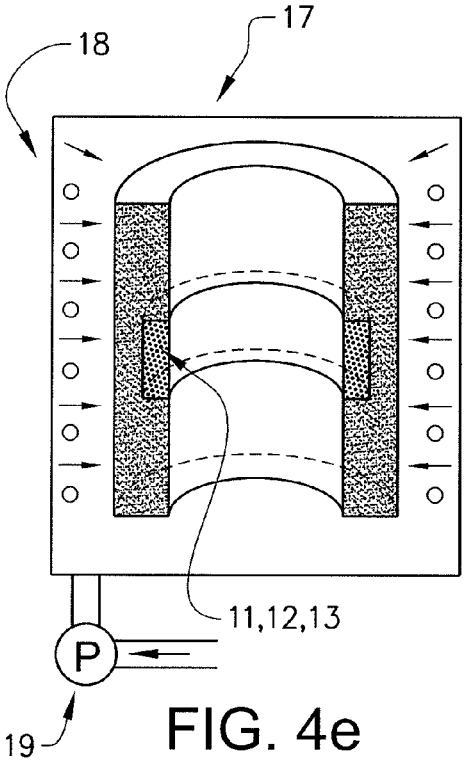

The capsule is placed in a heatable pressure chamber 17, see FIG. 4*e*. The chamber 17, normally referred to as a HIP-chamber can be pressurized to a pressure of at least 100 bars and heated to a temperature of at least 1000° C. by heating elements 18 arranged in the chamber 17. Pressurizing of the chamber 17 may be achieved in that a pump 19 pumps air or gas, such as argon into the chamber 17. The capsule 10 is heated to a temperature below the melting point of the powder materials in the capsule, e.g. 100-500° C. below the melting point and the pressure is increased in the chamber 17. The capsule is thereby subjected to heat and isostatic pressure.

Due to the elevated pressure and temperature the particles of the powders in the capsule deform plastically and bond together through various diffusion processes. The combination of these processes causes pores to shrink and close, thereby achieving a fully dense body without any residual porosity after HIP. After a predetermined time, for example 1-2 hours the heating elements in the capsule are turned off and the pressure is decreased to atmospheric pressure. The capsule 10 is then allowed to cool and is subsequently stripped from the sintered article.

The manufactured article may be subjected to further treatment such as grinding, boring, painting or coating.

According to a first preferred embodiment of the method, the body 11 comprises a shell 12 that comprises the gasifiable material wherein the shell is filled with a powder of the second material.

FIG. 5*a* through 5*e* illustrates shells of various configurations. The shell 12 comprises an outer wall 12.1, a bottom wall 12.3 and a top wall 12.4. The walls may be of any thickness dimension and define a volume which can be filled with powder material. The top wall 12.4 may be provided with an opening 12.5 through which powder material may be poured. The shell may be of ring-shaped configuration (FIG. 5*a*), in which case the shell also includes an inner wall 12.2.

According to a first alternative, the shell 12 is a polymer shell 12 of a type of polymer described above, for example polypropylene, polyethylene or polyoxymethylene. The shell 12 may be formed by various manufacturing techniques for example, blow moulding, injection moulding, casting, free form fabrication, or by mechanically working of tube or sheet material of polymer material.

According to a second alternative, the shell 12 comprises a mixture of polymer material and a powder of the first material and/or a powder of the second material. Alternatively, the mixture comprises a third powder material different from the powders of the first and second materials.

The polymer material in the shell 12 is of a type described above, for example polypropylene, polyethylene or polyoxymethylene. The shell 12 is manufactured by mixing polymer powder and powders of the first material and/or the second material etc. A wetting agent may be added for improving the bond strength between powder particles during manufacturing of the shell. The shell 12 is then formed by any suitable manufacturing technique, for example by extrusion or 3D-printing. The shell 12 is thereafter heated to a temperature slightly above the melting point of the polymer powder. As the shell 12 cools the polymer material solidifies and adhere thereby the powder of the first and/or second material.

The amount of polymer powder in the mixture may be adjusted such that the volume of the polymer powder is essentially equal to the volume of the voids between the particles of the powder material. In the shell the polymer is then essentially only present in the voids between the particles of the powder material and distortion due to volume changes when the polymer material is removed by gasification is thereby minimized.

The shell 12 may also comprise an outer layer of a third material, for example nickel which protects against diffusion of elements such as carbon between the shell and the content of the shell, or diffusion between the shell and the powder material surrounding the shell.

Figure 5A:
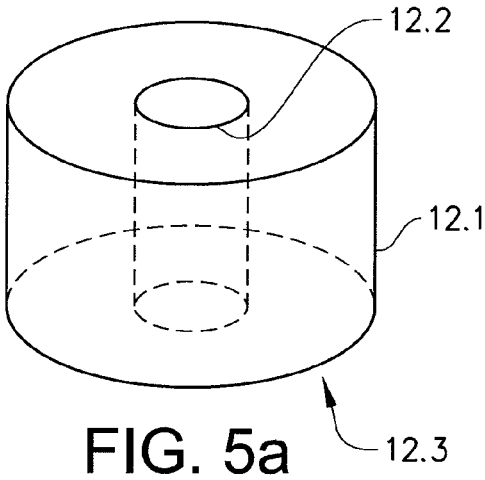
FIG. 5*a*-5*f* illustrates shells that are used in a first preferred embodiment of the inventive method.
Figure 5B:
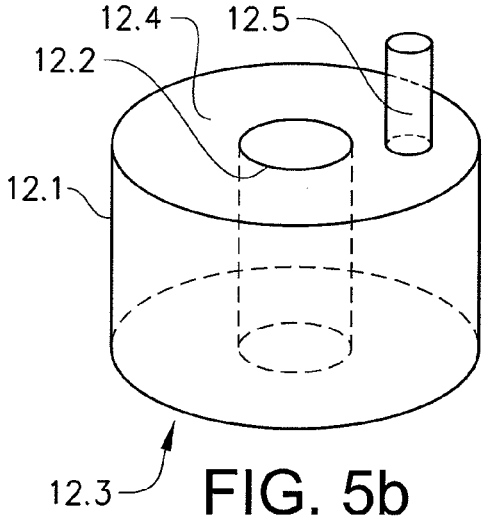
Figure 5C:
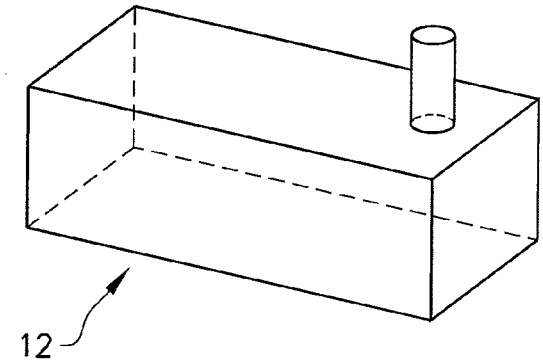
Figure 5D:
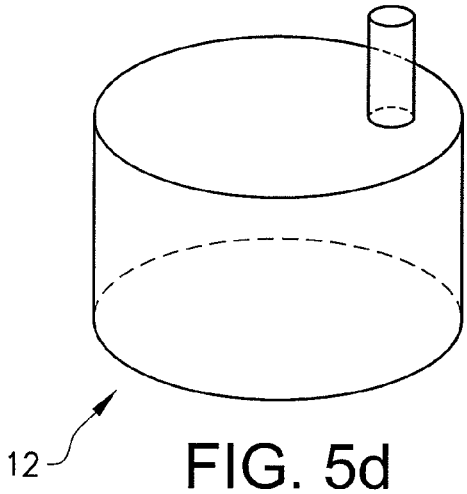
Figure 5E:
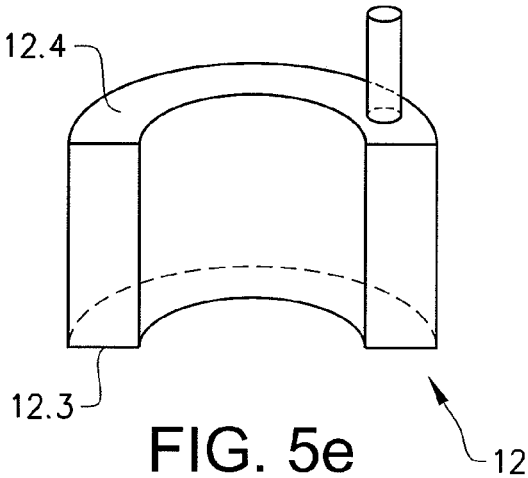
Figure 5F:
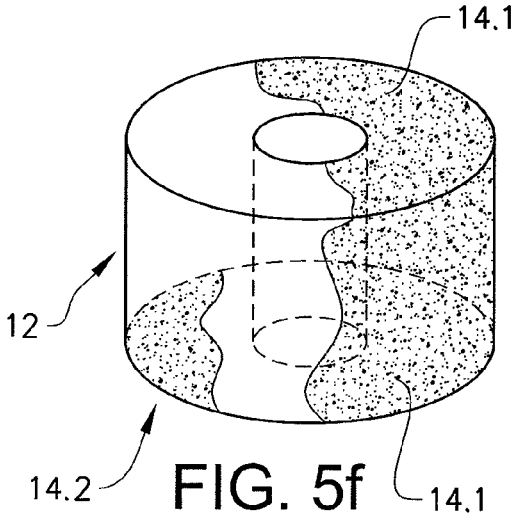

The layer may be achieved by applying a thin metal sheet on the shell 12. When the shell 12 is manufactured from powder material a diffusion protection layer which comprises polymer material and a third powder material, for example nickel, may be applied on the surface of the shell 12. FIG. 5*f* shows a shell 12 which comprises an outer layer 14.1 of a third material.

The shell 12 is filled with at least a powder of the second material and arranged in the capsule as described in the first step 100 of the method.

According to a first alternative, the shell 12 is pre-filled, thus filled in advance with a powder of the second material. The shell is then arranged in the capsule 10. Thereafter is the capsule 10 filled with a powder of the first material as described in the second step 200 of the method.

According to a second alternative, the shell 12 is first arranged in the capsule 10. The shell is then filled with a powder of the second material. In this case, the step of arranging the shell 12 in the capsule comprises the sub-step of arranging the shell in the capsule and the sub-step of filling the shell 12. Thereafter is the capsule 10 filled with a powder of the first material as described in the second step 200 of the method. The shell 12 and the capsule 10 may also be filled simultaneously According to a third alternative, the capsule 10 is first partially filled with the powder of the first material. The shell 12 is then arranged in the capsule 10. The shell 12 is then filled with a powder of the second material. In this case, the step of arranging the shell 12 in the capsule comprises the sub-step of arranging the shell in the capsule and the sub-step of filling the shell 12. Thereafter is the capsule 10 filled with the powder of the first material as described in the second step 200 of the method. The shell 12 may also be pre-filled with a powder of the second material.

The capsule is thereafter subjected to the described steps 300, 400 and 500 of the method.

According to a second embodiment of the method, the body 11 comprises a solid body 13, which comprises a mixture of a polymer material and at least a powder of the second material.

The body 13 is pre-fabricated thus, manufactured in advance by mixing polymer powder and powder of the second material and a wetting agent. The polymer powder is the type described above, for example polypropylene, polyethylene or polyoxymethylene A wetting agent may be added to the mixture. The mixture is then formed, for example by injection moulding, extrusion, 3D-printing or any other suitable manufacturing method into a body 13 of a specified geometry.

The body 13 is then heated, normally to a temperature slightly above the melting point of the polymer powder. As the body 13 cools the molten polymer material solidifies and adhere thereby the powder of the second material into a solid body. The pre-fabricated bodies may be stored for long times until needed.

The body 13 may comprise portions of different powder materials.

Figure 6A:
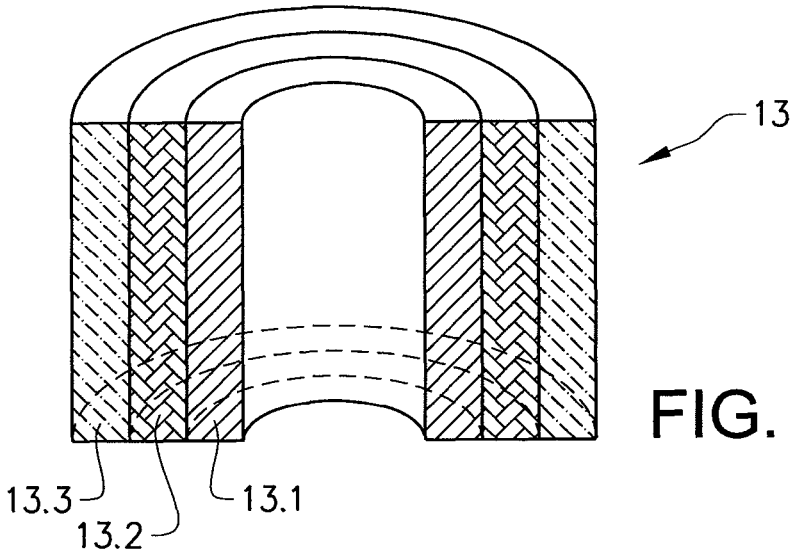
FIG. 6*a*-6*c* illustrates pre-fabricated bodies that are used in a second preferred embodiment of the inventive method.

According to a first alternative, the body 13 exhibits a concentration gradient from one side to another. FIG. 6*a* illustrates a body 13 comprising three layers of different concentrations. A first layer 13.1 comprises one part polymer material and nine parts of a powder of the second material. A second layer 13.2 comprises one part polymer material, six parts of a powder of the second material and three parts of a powder of the first material. A third layer 13.3 comprises one part polymer material, one part of a powder of the second material and eight parts of a powder of the first material.

Figure 6B:
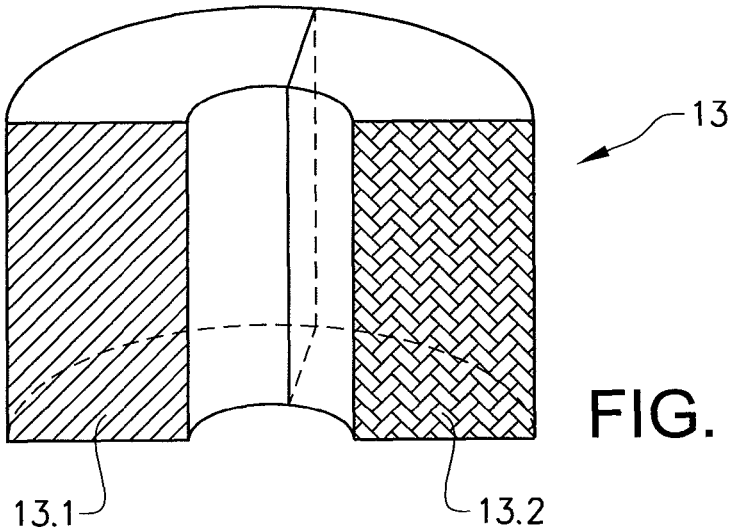

According to a second alternative, see FIG. 6*b*, the body 13 may comprise one portion 13.1 of a powder of the second material and one portion of a powder of a material 13.2.

Figure 6C:
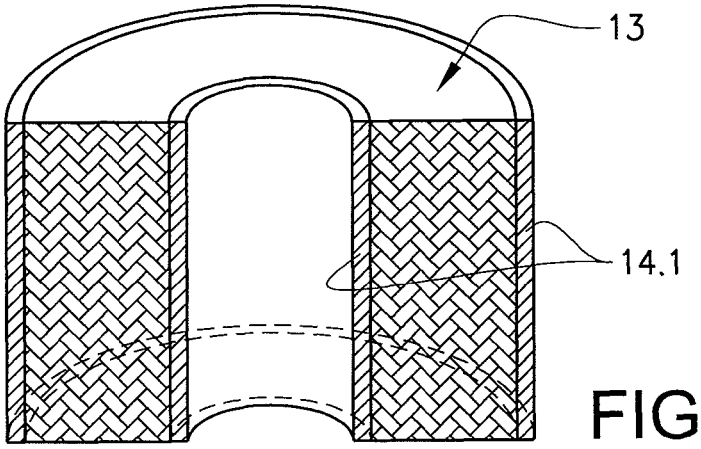

According to a further alternative, see FIG. 6*c* the body 13 comprises an outer layer 14.1 of polymer material and a powder of a third material, such as nickel. The layer 14.1 provides protection against diffusion of elements between from the body 13 and the surrounding powder material.

The body 13 is arranged in the capsule 10 as described in first step 100 of the method.

Several bodies, that have different concentration ratios between the powders of the first and the second materials, may be arranged next to each other in the capsule 10. A gradient of the concentration of the second material is thereby achieved from the surface of the article towards the centre of the article.

Figure 7A:
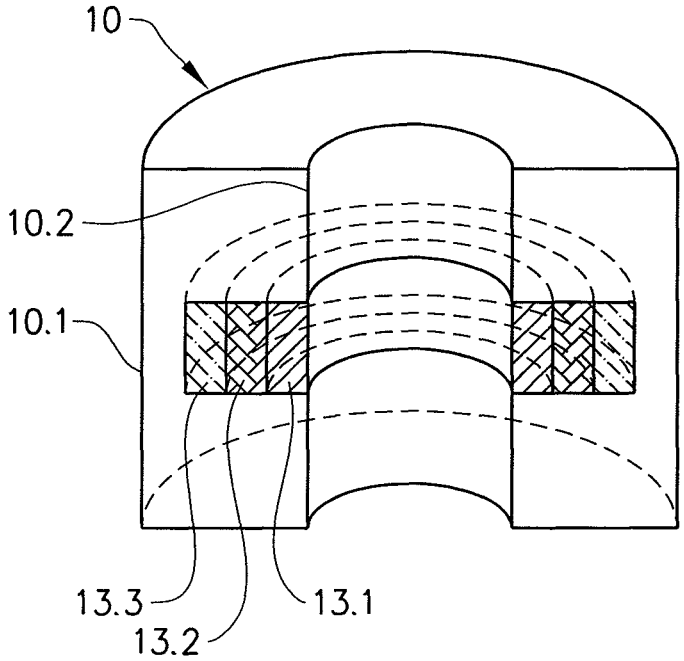
FIGS. 7*a* and 7*b* illustrates the arrangement of prefabricated bodies in the capsule.

FIG. 7*a* illustrates an example in which several bodies 13.1, 13.2, 13.3 are arranged so that a concentration gradient is achieved in a direction from the inner cylindrical wall 10.2 of the capsule 10 towards the outer cylindrical wall 10.1. The first pre-fabricated body 13.1 comprises one part polymer material and nine parts of a powder of the second material. The second pre-fabricated body 11.2 comprises one part polymer material, six parts of a powder of the second material and three parts of a powder of the first material. The third pre-fabricated body 13.3 comprises one part polymer material, three parts of a powder of the second material and six parts of a powder of the first material.

Figure 7B:
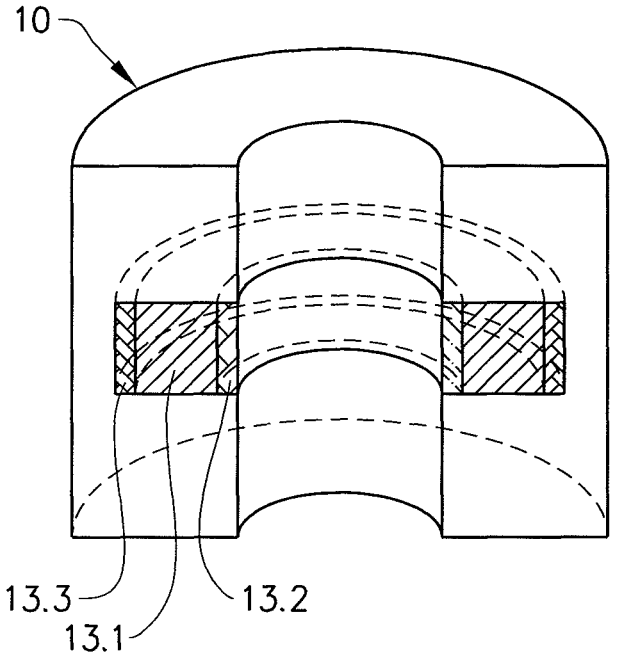

According to a further alternative, see FIG. 7*b*, a first body 13.1 comprising polymer material and a powder of the second material is arranged in the capsule 10. One or several further bodies 13.2, 13.3 that each comprises polymer material and a powder of a third material, for example Ni may be arranged next to the first body 13.1, in contact with the surfaces of body 13.1. Thereby is achieved that diffusion of elements between body 11 and the surrounding powder of the first material of the article is prevented.

The capsule 10 is then filled with the powder of the first material as described in the second step 200 of the method. The capsule 10 is thereafter subjected to the steps 300, 400 and 500 of the method.

Although particular embodiments have been disclosed herein in detail, this has been done for purposes of illustration only, and is not intended to be limiting with respect to the appended claims. The disclosed embodiments and alternatives can also be combined. In particular, it is contemplated by the inventor that various substitutions, alterations, and modifications may be made to the invention without departing from the scope of the invention as defined by the claims. For example could the method be used to manufacture articles into which are integrated bodies which serve other purposes than to reinforce the article. For example, bodies which comprises magnetic material which are used as a detection marker for detecting equipment.

The invention claimed is:

1. A method for manufacturing a powder based article comprising one portion of a first material and at least one portion of a second material, the method comprising:

arranging at least a first body in a selected portion or selected portions in a capsule defining the shape of the article, wherein the first body comprises a mixture of a powder of the second material and a gasifiable material and the powder of the second material is held by the gasifiable material;

filling the capsule with a powder of the first material;

removing the gasifiable material;

sealing the capsule; and heating the capsule under increased pressure to a temperature at which the powders of the first and second materials densifies to a compact article, wherein the first body comprises one or more shells, and wherein the shell or shells are filled or prefilled with at least the powder of the second material.

2. The method according to claim 1, wherein the first body is arranged at an inner surface of a wall of the capsule so that the first body is partially enclosed in the powder of the first material.

3. The method according to claim 1, wherein the first body is arranged at a distance from an inner surface of a wall of the capsule so that the first body is enclosed in the powder of the first material.

4. The method according to claim 1, wherein the capsule forms a hollow cylinder, and wherein the first body is arranged in contact with a mantle surface of an inner wall of the cylinder, partially enclosing the mantle surface.

5. The method according to claim 1, wherein the capsule forms a hollow cylinder with a curved section, and wherein the first body is arranged in contact with a mantle surface of an inner wall of the cylinder, partially enclosing the mantle surface.

6. The method according to claim 1, wherein the mixture further comprises the powder of at least the first material or a powder of at least a third material.

7. The method according to claim 1, wherein, prior to filling or prefilling the shell or shells with at least the powder of the second material, the capsule is partially filled with the powder of the first material, the one or more shells of the first body are arranged in the capsule, and the capsule is completely filled with the powder of the first material.

8. The method according to claim 1, wherein several bodies are arranged in the capsule.

9. The method according to claim 8, wherein each of the several bodies comprises a powder of a different material.

10. The method according to claim 1, wherein the first material is Ni-alloys, Co-alloys, tool steels, carbon steels, Hadfield-type steels, stainless steels or mixtures thereof.

11. The method according to claim 1, wherein the first body comprises second, third or further materials and the composition of the second, third or further materials is one or more of Ni-alloys, Co-alloys, tool steels, carbon steels, Hadfield type steels, stainless steels or mixtures of the aforementioned materials or ceramics, metal matrix composites or mixtures thereof.

12. The method according to claim 1, wherein the gasifiable material is a thermal gasifiable polymer material, and wherein the step of removing the polymer material from the capsule comprises the sub-steps of:

applying a vacuum in the capsule;

heating the capsule to a temperature at which the polymer material is gasified.

13. The method according to claim 1, wherein the gasifiable material is a chemically gasifiable polymer material, and wherein the step of removing the polymer material from the capsule comprises the sub-steps of:

applying a vacuum in the capsule;

injecting in the capsule a gas which chemically reacts with the polymer such that the polymer material is gasified.

14. The method according to claim 10, wherein stainless steels is selected from the group consisting of martensitic stainless steels, chromium steels, austenitic stainless steels, and duplex stainless steels.

15. The method according to claim 12, wherein the thermal gasifiable polymer material is polypropylene or polyethylene.

16. The method according to claim 13, wherein the chemically gasifiable polymer material is polyoxymethylene.

17. The method according to claim 1, wherein the shell or shells comprise an outer layer of a third material.

18. A method for manufacturing a powder based article comprising one portion of a first material and at least one portion of a second material, the method comprising:

arranging at least a first body in a selected portion or selected portions in a capsule defining the shape of the article, wherein the first body comprises one or more solid bodies of a mixture of gasifiable polymer material and at least a powder of the second material and the powder of the second material is held by the gasifiable material;

filling the capsule with a powder of the first material;

removing the gasifiable material;

sealing the capsule; and heating the capsule under increased pressure to a temperature at which the powders of the first and second materials densifies to a compact article, wherein the first body further comprises layers or portions of powders of different materials.

19. The method according to claim 18, wherein the capsule is partially filled with the powder of the first material, wherein the one or more solid bodies subsequently are arranged in the capsule after the capsule is completely filled with the powder of the first material.

20. The method according to claim 18, wherein several bodies are arranged in the capsule.

21. The method according to claim 20, wherein each of the several bodies comprises a powder of a different material.

22. The method according to claim 18, wherein the layers establish a concentration gradient.

* * * * *